US008459193B2

(12) United States Patent
Mulcahy

(10) Patent No.: US 8,459,193 B2
(45) Date of Patent: Jun. 11, 2013

(54) DEVICE AND METHOD FOR GASIFICATION AND/OR PYROLYSIS, OR VAPORIZATION OF COMBUSTIBLE MATERIALS

(76) Inventor: Nathaniel Mulcahy, Amherst, MA (US)

( * ) Notice: Subject to any disclaimer, the term of this patent is extended or adjusted under 35 U.S.C. 154(b) by 263 days.

(21) Appl. No.: 13/128,002

(22) PCT Filed: Nov. 6, 2009

(86) PCT No.: PCT/IB2009/054934
§ 371 (c)(1),
(2), (4) Date: May 6, 2011

(87) PCT Pub. No.: WO2010/052667
PCT Pub. Date: May 14, 2010

(65) Prior Publication Data

US 2011/0209698 A1 Sep. 1, 2011

(30) Foreign Application Priority Data

Nov. 7, 2008 (IT) ..... TO2008A0823

(51) Int. Cl.
*F23G 5/12* (2006.01)

(52) U.S. Cl.
USPC ..... 110/229

(58) Field of Classification Search
USPC ..... 110/229, 346, 213, 309, 310, 313, 110/315, 316, 182.5; 126/25 R, 15 A, 39 R, 126/39 E, 76; 431/354
See application file for complete search history.

(56) References Cited

U.S. PATENT DOCUMENTS 4,738,205 A 4/1988 Beierle et al.
5,010,728 A 4/1991 Joy (Continued)

FOREIGN PATENT DOCUMENTS

FR 0900525 10/1943
WO 2006/103613 A2 10/2006
WO 2008/001276 A2 1/2008

OTHER PUBLICATIONS

International Search Report for PCT Application No. PCT/IB2009/06276 from which priority is claimed, Dated Sep. 8, 2010.

(Continued)

*Primary Examiner* — Kenneth Rinehart
*Assistant Examiner* — Jason Lau
(74) *Attorney, Agent, or Firm* — Altman & Martin; Steven K Martin

(57) ABSTRACT

The device comprises: an inner chamber (56) which has an upper aperture or mouth (36) and is delimited by a lateral wall (20) and by a base wall (19), and which is intended to contain a primary fuel to be subjected to gasification and/or pyrolysis or vaporization to generate combustible gases; an outer chamber (58) delimited by an outer lateral wall (22) positioned coaxially with the outside of the lateral wall (20) of the inner chamber (56), by a base wall (14) which is located under the base wall (19) of the combustion chamber (56) and which has at least one aperture (28) communicating with the external environment, and by a top wall which unites the outer (22) and inner (20) lateral walls, in such a way that the outer chamber (58) comprises a lower portion positioned under the inner chamber (56) and an upper annular portion (59) which surrounds the inner chamber (56); a plurality of circumferentially staggered lower passages (50) through which the base of the inner chamber (56) communicates with the surrounding annular portion (59) of the outer chamber (58); and a plurality of circumferentially staggered upper passages (39) through which the top of the annular portion (59) of the outer chamber (58) communicates with the top of the inner chamber (56).

11 Claims, 12 Drawing Sheets

U.S. PATENT DOCUMENTS

| | | | |
|---|---|---|---|
| 5,089,030 | A | 2/1992 | Michel-Kim |
| 6,336,449 | B1 | 1/2002 | Drisdelle et al. |
| 6,422,231 | B1 | 7/2002 | Hamilton et al. |
| 6,615,821 | B1 | 9/2003 | Fisenko |
| 6,830,597 | B1 | 12/2004 | Green |
| 6,972,114 | B2 | 12/2005 | Pope et al. |
| 6,981,366 | B2 | 1/2006 | Sharpe |
| 7,107,983 | B1 | 9/2006 | West |
| 2003/0200905 | A1 | 10/2003 | Reed |

OTHER PUBLICATIONS

Reed, TB et al., "Testing & Modeling the Wood-Gas Turbo Stove," Progress in Themochemical Biomass Conversion Conference, Sep. 17, 2000, pp. 1-14.

Hegarty, Satisfying a Burning Need, Oct. 1, 2006, retrieved from URL: http://www.research.philips.com/password/archive/28/downloads/password28.pdf.

Written Opinion of the International Searching Authority for Application No. PCT/IB2009/054934 dated May 10, 2011.

FIG. 10
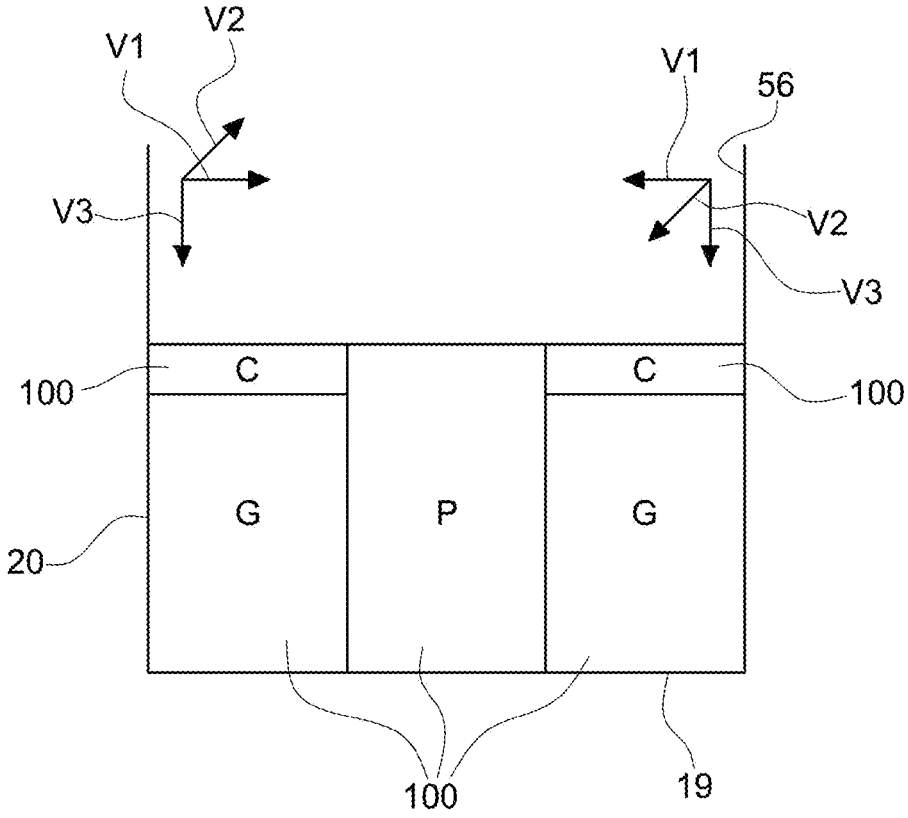
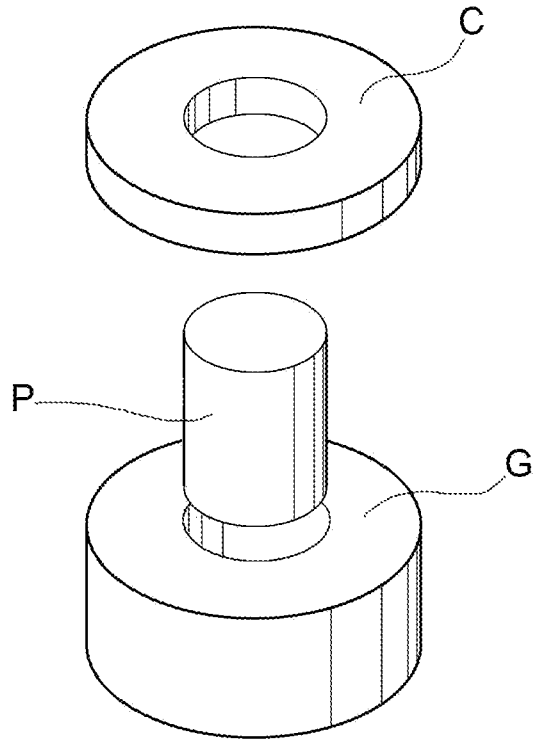
FIG.10a

DEVICE AND METHOD FOR GASIFICATION AND/OR PYROLYSIS, OR VAPORIZATION OF COMBUSTIBLE MATERIALS

TECHNICAL FIELD

The present invention relates to a device and method for the use of combustible materials, and more specifically to a device and method for gasification and/or pyrolysis, or vaporization of combustible materials.

PRIOR ART

The fields in which the present invention can be applied are so various that the following list of prior patents is provided purely as a sample of the prior art.

U.S. Pat. No. 6,981,366 describes a jet engine without moving parts, with a plurality of compression stage and mixing of air and fuel followed by expansion in a combustion region.

U.S. Pat. No. 5,010,728 describes a turbine engine which uses a mixture of gaseous and solid fuels.

US patent application 2003/0200905 describes a process for producing a gas from solid fuels and for burning this gas in an associated combustor to produce "clean" heat.

U.S. Pat. No. 6,422,231 describes a portable stove with a burner at the bottom.

U.S. Pat. No. 7,107,983 describes a portable stove with a cylindrical or frusto-conical lateral wall formed by bending a metal sheet whose ends can be fastened and unfastened, in such a way that this wall can be put into the extended flat configuration for transport and/or stowage.

U.S. Pat. No. 6,615,821 describes a camp stove for combustion with coaxial cylindrical walls.

U.S. Pat. No. 4,738,205 describes a stove comprising a pyrolysis gasifier.

U.S. Pat. No. 6,336,449 describes a burner device with coaxial cylinders for solid fuels, for a heating apparatus.

U.S. Pat. No. 5,089,030 relates to an apparatus for producing generator gas and activated carbon from solid fuels.

U.S. Pat. No. 6,972,114 describes a biomass gasifier apparatus.

Finally, U.S. Pat. No. 6,830,597 describes a pyrolysis method and apparatus for gasifying and/or liquefying biomass.

The article "A Wood-Gas Stove for Developing Countries", by T. B. Reed and R. Larson, presented at the "Developments in Thermochemical Biomass Conversion" Conference, Banff, Canada, 20-24 May 1996, describes a stove in which clean ("blue flame") combustion is achieved by using a "gas wick" which optimizes and stabilizes the flame position.

OBJECT OF THE INVENTION

One object of the present invention is to propose a device and a method for gasification, vaporization and/or pyrolysis of a combustible material, this device and method being optimized and having efficiency characteristics which are markedly superior to those of the prior art.

A further object of the invention is to provide a gasification, vaporization and/or pyrolysis device having a considerably simplified modular structure and having extremely low costs of production, storage and transport.

BRIEF DESCRIPTION OF THE INVENTION

These and other objects are achieved according to the invention by means of a device whose salient features are defined in the appended claim 1, and by means of the method whose principal aspects are defined in claim 19.

DESCRIPTION OF THE DRAWINGS

Other features and advantages of the present invention will become clear from the following detailed description which is given purely by way of non-limiting example, with reference to the attached drawings, in which:

FIG. 10 is a simplified schematic representation in longitudinal section of the inner chamber of the device according to the invention, in a gasification stage of operation;

FIG. 10*a* is an exploded perspective view showing the different parts of the body of fuel contained in the aforesaid inner chamber;

DETAILED DESCRIPTION

Figure 1:
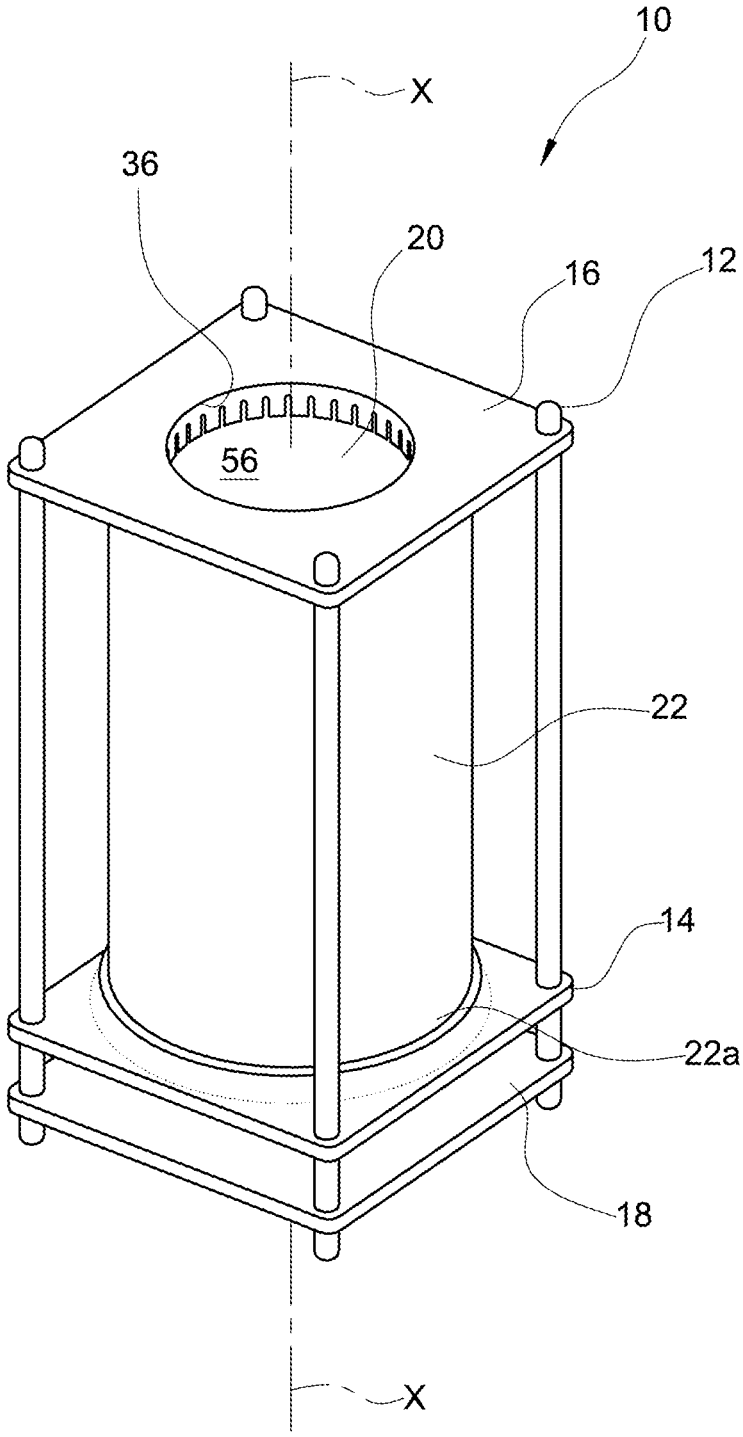
FIG. 1 is a perspective view of an exemplary embodiment of a device according to the present invention.

With reference to FIG. 1 in particular, the number 10 indicates an exemplary embodiment of a device according to the present invention.

The device 10 comprises, for example, four support rods 12, to whose upper and lower ends a base plate 14 and a top plate 16, respectively, are fixed in a known way. Optionally, the combustor device 10 can be provided with a lower guide plate 18, also fixed to the support rods 12, under the base plate 14.

The combustor device 10 also comprises an inner tubular wall 20 which extends about a longitudinal axis X-X, and a coaxial outer tubular wall 22.

The walls 20 and 22 can be made in the form of portions of tubes, or can be produced by bending sheets or panels and overlapping the edges.

Figure 2:
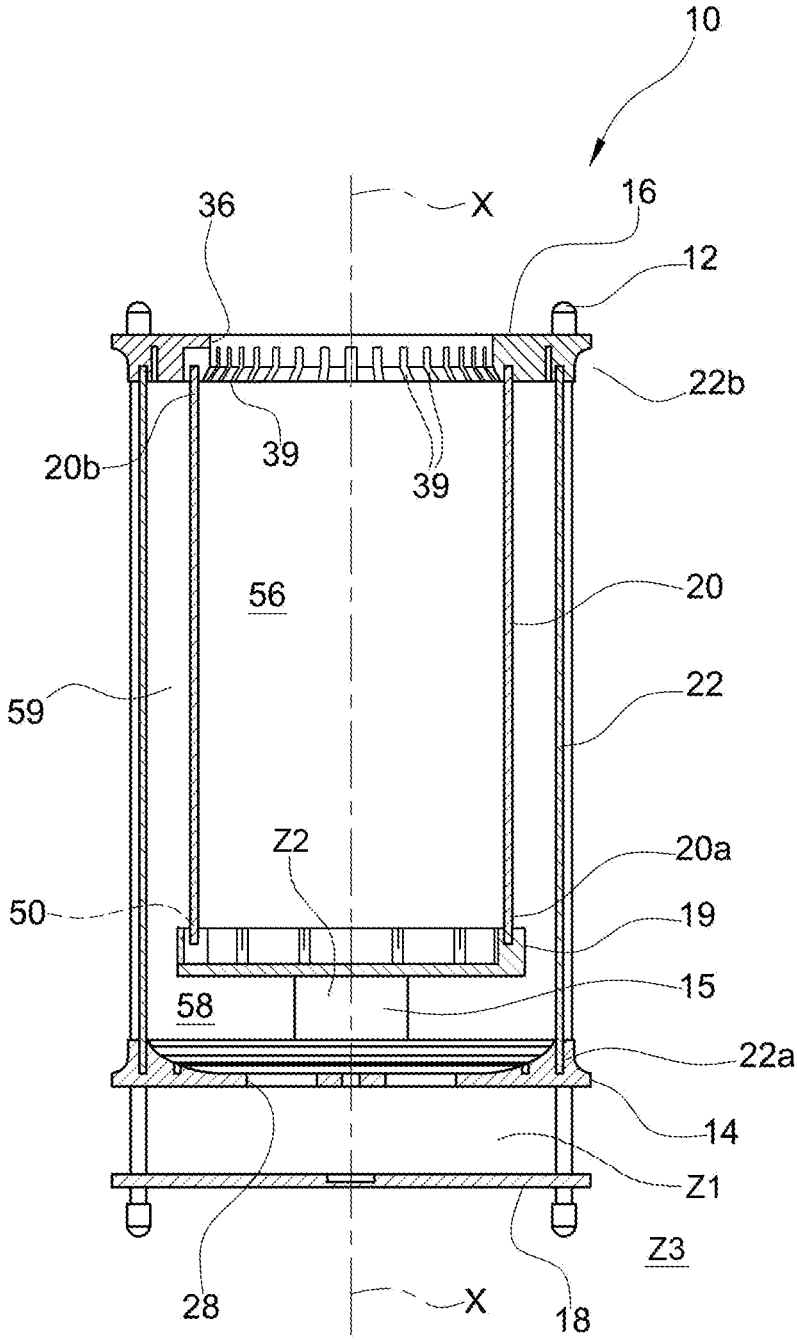
FIG. 2 is a view in longitudinal section of the device shown in FIG. 1.

As shown in FIG. 2, the device 10 also comprises a support block 15, of substantially parallelepipedal shape, bearing firmly on the base plate 14, and a lower dividing plate 19 which in turn bears in a stable way on the support block 15.

Figure 3:
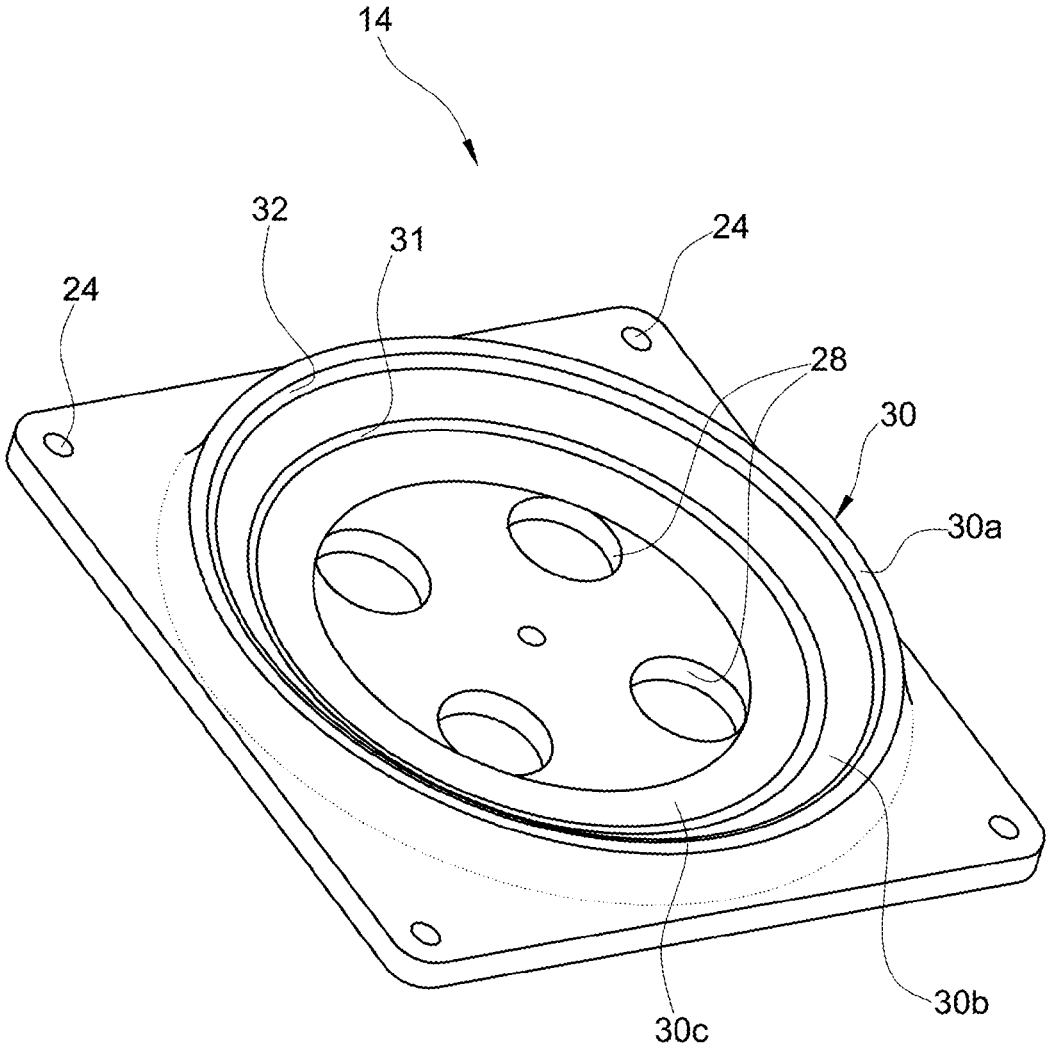
FIG. 3 is a perspective view of a base plate of the device shown in the preceding figures.
Figure 4:
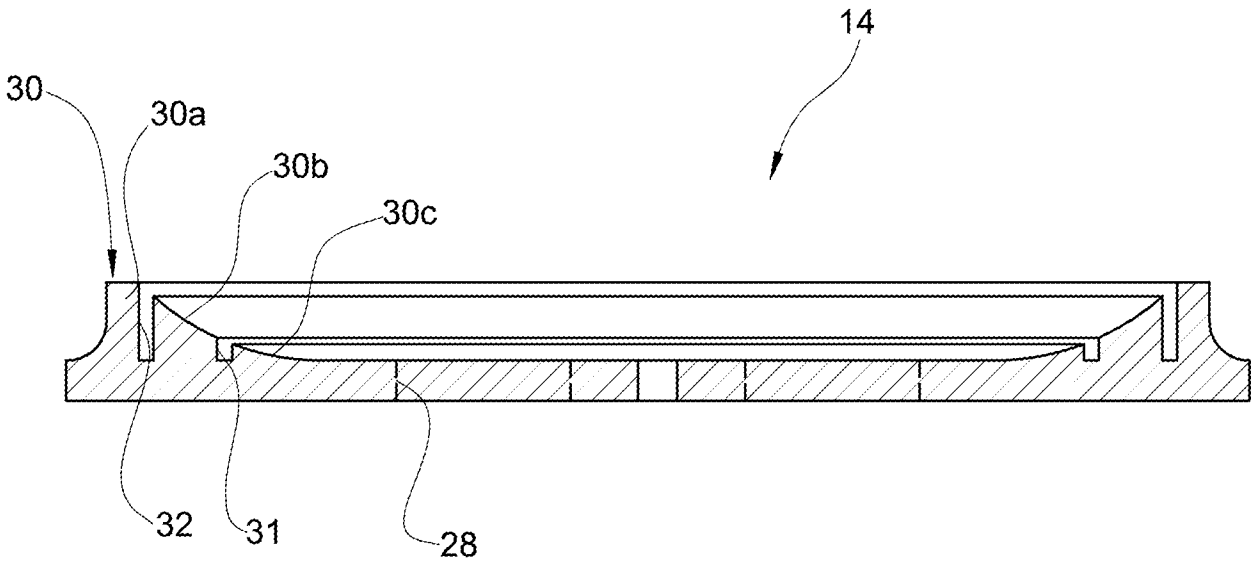
FIG. 4 is a sectional view of the base plate shown in FIG. 3.

With reference to FIGS. 3 and 4 in particular, these show further details of the base plate 14.

In the illustrated embodiment, the plate 14 is substantially square and has four corner holes 24 which are designed to be penetrated and joined in a known way to the four support rods 12. The central portion of this base plate 14 has four passages or apertures 28 which are located in axially symmetrical positions with respect to the centre of the plate. In a transversely outer position with respect to the base apertures 28, the plate 14 also has a circumferential base projection 30 which has the shape of a substantially rectangular trapezium in cross section. The annular projection 30 has two coaxial grooves 31 and 32, namely an inner and an outer groove respectively, which divide it into an outer ring 30*a*, an intermediate ring 30*b* and an inner ring 30*c*.

The outer ring 30*a* can be higher than the intermediate ring 30*b*, which has an upper surface inclined towards the axis and downwards. The inner ring 30*c* can be lower than the intermediate ring 30*b*, and its upper surface is also inclined towards the centre and downwards.

Figure 5:
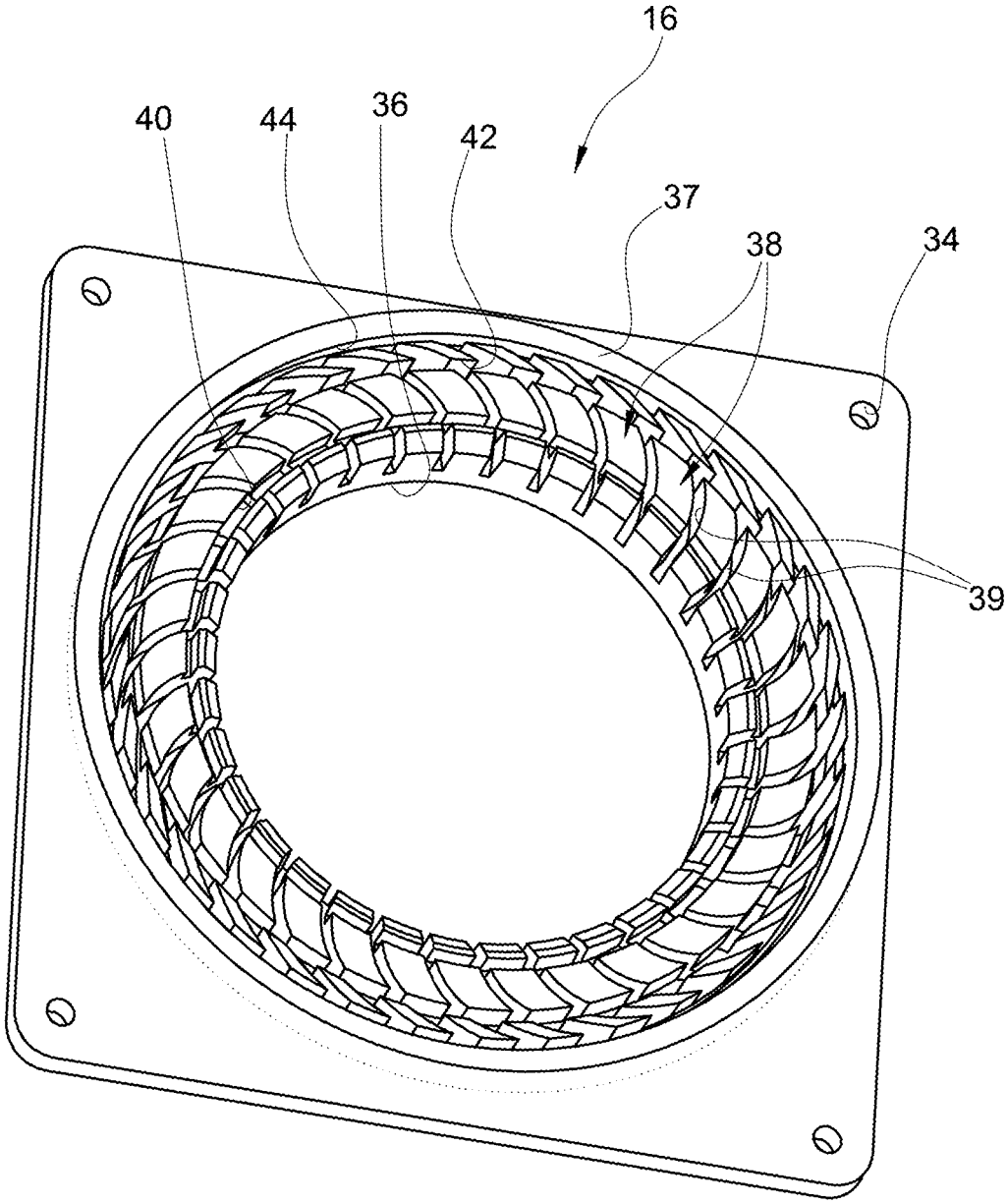
FIG. 5 is a perspective view of a top plate of the device shown in FIGS. 1 and 2.
Figure 5A:
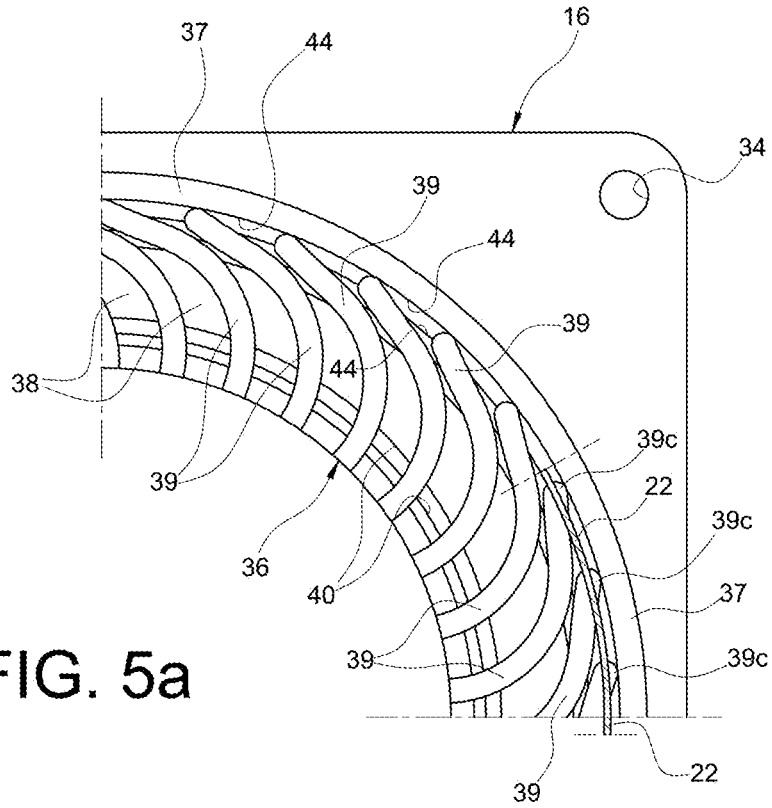
FIG. 5*a* is a partial plan view from below of the top plate shown in FIG. 5.

With reference to FIGS. 5, 5*a* (or 5*b*) and 6, the top plate 16 is also substantially quadrangular and also has four holes 34 designed to be penetrated and joined in a known way to the four support rods 12.

The top plate 16 has a central aperture or mouth 36 of substantially circular shape. A circumferential projection 37 extends below and radially outwards with respect to the central aperture 36. A plurality of curved projections 38, staggered circumferentially, are formed between the projection 37 and the central aperture 36, and create between them a plurality of channels or grooves 39 converging towards the central aperture 36.

Figure 5B:
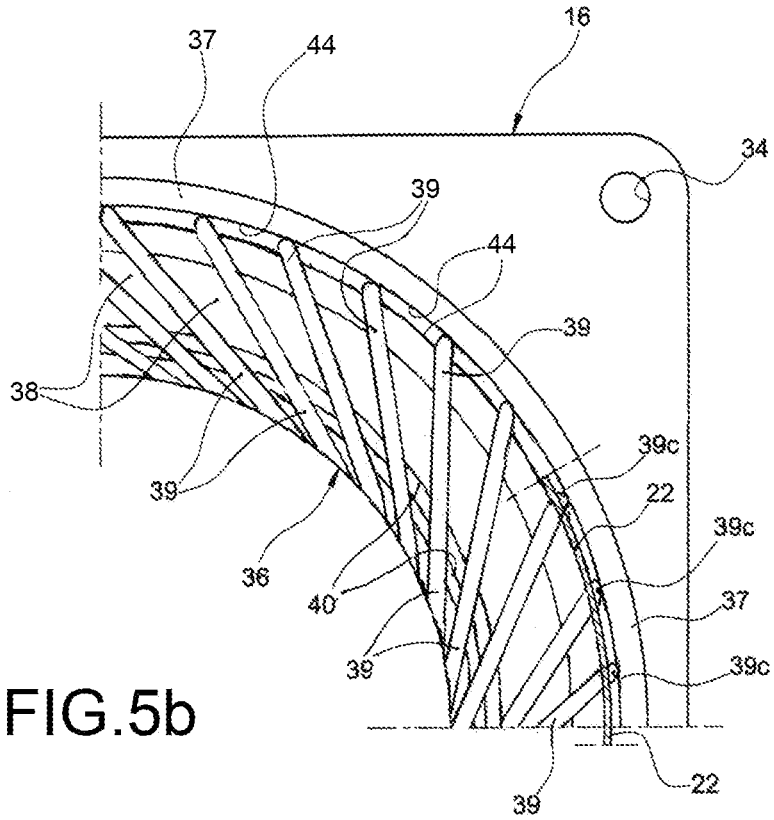
FIG. 5*b* is similar to FIG. 5*a* and shows a variant embodiment of said top plate.
Figure 6:
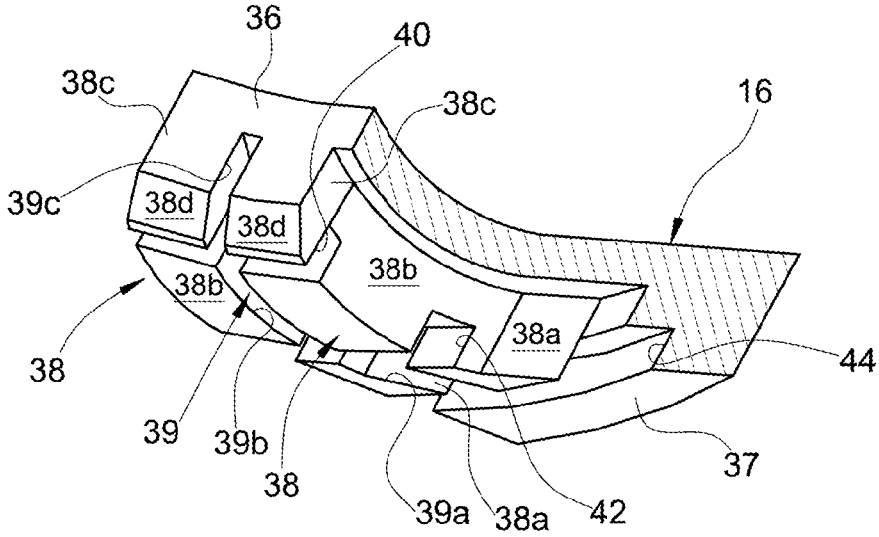
FIG. 6 is a partial perspective view in partial section of the top plate shown in FIG. 5*a;*

In the embodiment shown in FIGS. 5, 5*a* and 6, the grooves 39 have a generally curved configuration. They can also have a linear configuration, as in the embodiment shown in FIG. 5*b*, provided that they open into the aperture or mouth 36 at an angle with respect to the radial direction, in order to create the vortex which is described more fully below.

The projections 38 are penetrated by an inner circumferential recess or groove 40, an intermediate groove 42 (optional) and an outer groove 44, which are positioned concentrically.

With reference to FIG. 5*a*, the grooves 39 are deeper than the circumferential grooves 40, 42 and 44, and their outer ends 39*c* extend radially beyond the outer wall 22, as can be seen in the right-hand part of said FIG. 5*a*. The wall 22 is effectively shaped in such a way that, in the assembled condition, it lies against the inner wall of the groove 44. In particular, the ends 39*c* of the grooves 39 communicate with the part of the groove 44 located outside the wall 22, forming passages enabling air (tertiary air) from the outside to be directed into the mouth 36.

If the outer wall 22 is made in the form of a bent sheet or panel, it can be treated in a known way after bending so that it tends to reclose and lies against the inner wall of the groove 44 in the assembled condition.

FIG. 6 shows a partial enlarged view of two adjacent projections 38 of the top plate 16.

Advantageously, starting from the outermost radial portion, the projections 38 have corresponding first rectilinear portions 38*a* between the outer groove 44 and the intermediate groove 42, delimiting between them corresponding first rectilinear portions 39*a* of the channels or grooves 39.

Between the intermediate groove 42 and the inner groove 40, the projections 38 have corresponding curved portions 38*b* which delimit corresponding intermediate curved portions 39*b* of the channels or grooves 39.

Between the inner groove 40 and the aperture or mouth 36, the projections 38 have end teeth 38*c*, each having a bevel 38*d* with inclined surfaces lying essentially on a conical surface coaxial with the aperture or mouth 36 and converging in an upward direction. Rectilinear portions 39*c* of the channels or grooves 39 are delimited between the teeth 38*c*.

Figure 7:
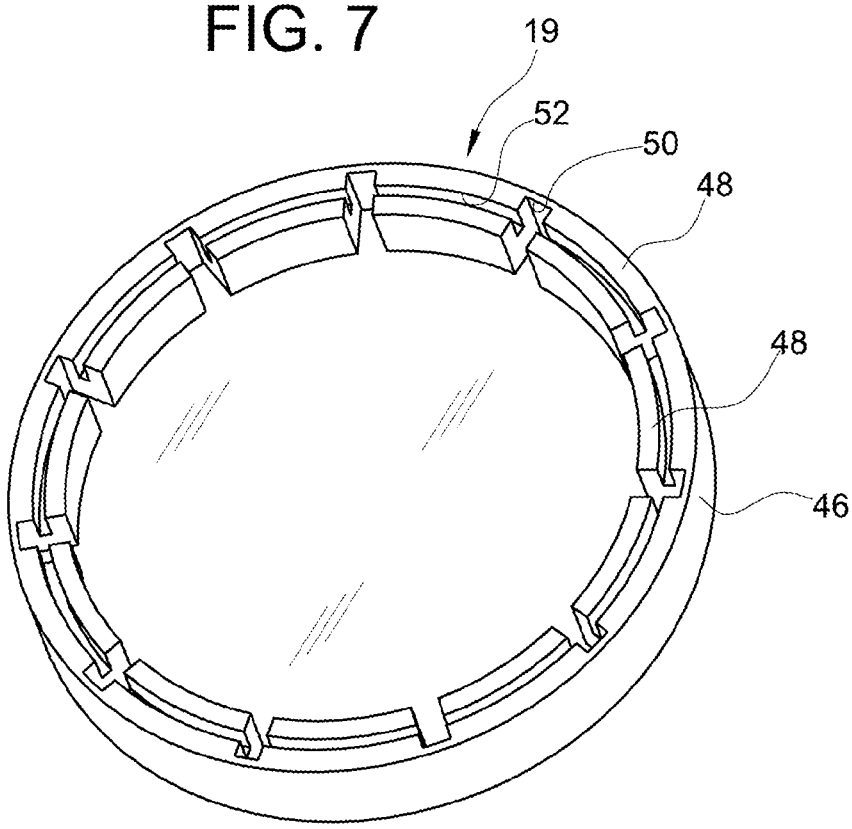
FIG. 7 is a perspective view of a lower plate of the device shown in FIGS. 1 and 2.

With reference to FIG. 7, the lower dividing plate 19 is substantially circular and has a projecting peripheral edge 46 which forms a plurality of projections 48 facing radially inward, alternating circumferentially with recesses or passages 50. A circular channel 52, whose depth is less than that of the passages 50, passes through the projections 48.

Figure 8:
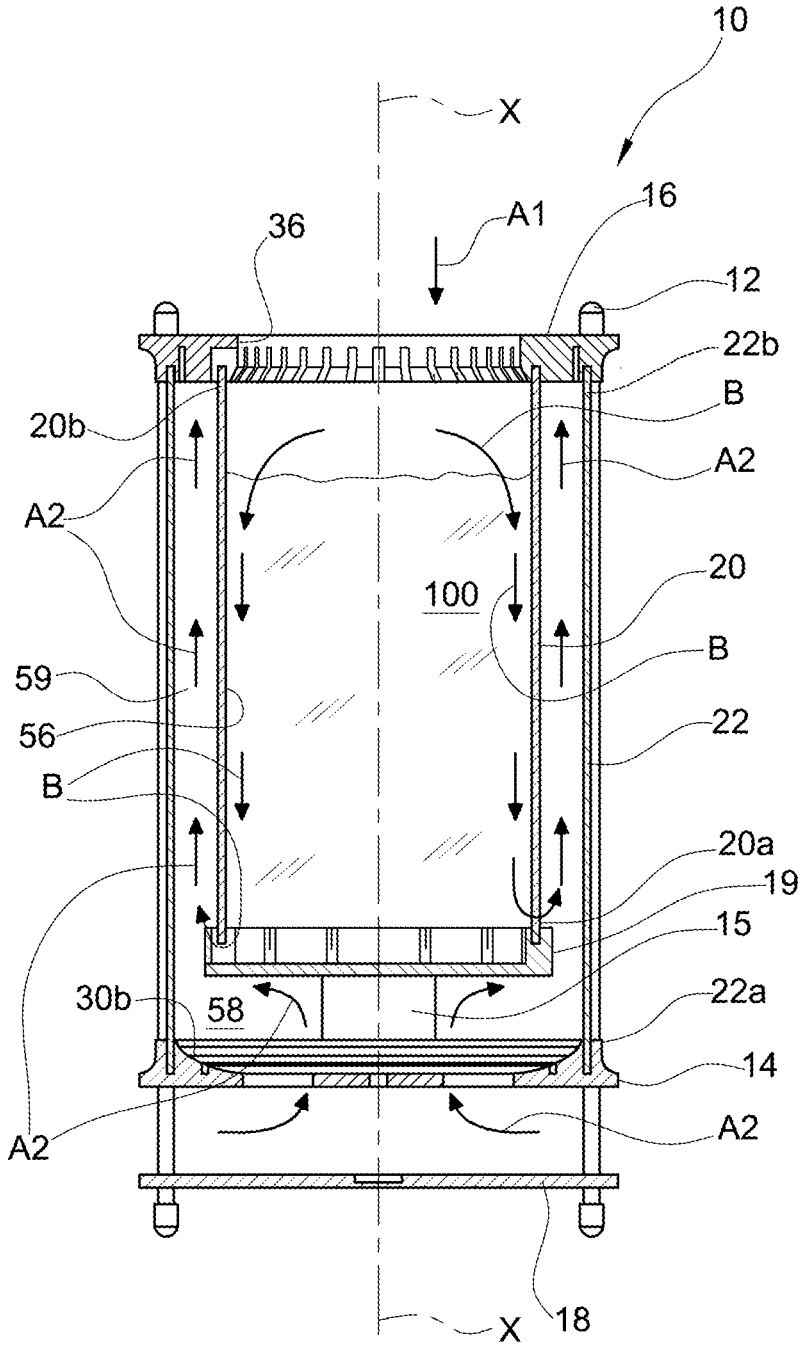
FIGS. 8 and 9 are views similar to that shown in FIG. 2, and show the gas flows in two different stages of the operation of the device.

With reference to FIGS. 1, 2 and 8, the guide plate 18 is quadrangular in shape, with four holes 54 designed to be penetrated and joined in a known way to the four support rods 12.

As shown in FIGS. 2 and 8 in particular, the inner lateral wall 20 and the outer lateral wall 22 are, for example, made from sheets of circular cylindrical shape. Each of these walls can be made from a panel of flexible material, bent in such a way that its ends partially overlap to form a substantially cylindrical tube.

The device 10 is assembled in the following way.

First of all, the guide plate 18, if present, is joined to the four support rods 12.

The base plate 14 is then joined to the four support rods 12, in a known way, in a position in which it is spaced away from and above the guide plate 18.

The support block 15 is then positioned centrally on the base plate 14, in a position between the four apertures 28, and the dividing plate 19 is then placed with its central region in contact with this support block 15.

The lower edge 22*a* of the outer lateral wall 2 is then placed in the circular groove 32 of the base plate 14 (see FIG. 2). Similarly, the lower edge 20*a* of the inner lateral wall 20 is placed in the circumferential channel 52 of the lower plate 19 (see FIG. 2).

The top plate 16 is then placed on the lateral wall 20, 22. More specifically, the upper edge 20*b* of the inner lateral wall 20 is inserted into the inner circumferential recess or groove 40 and the upper edge 22*b* of the outer lateral wall 22 is inserted into the outer circumferential recess or groove 44.

It may be noted that assembly (and disassembly) is a simple matter, since it is only necessary to place the individual components on top of each other, without the need for special fastenings.

By making the walls 20 and 22 from two bent sheets, assembly is facilitated, and storage and/or transport in the disassembled condition becomes more convenient.

Upon completion of the assembly, the device 10 has an inner chamber 56 defined by the space enclosed by the inner lateral wall 20 and the dividing plate 19. This chamber 56 is open at the top, where the central mouth 36 is located. The device 10 also has an outer chamber 58, defined by the space enclosed by the base plate 14, the top plate 16, the dividing plate 19 and the inner and outer lateral walls 20, 22. The outer chamber 58 therefore comprises an upper annular portion 59 and a lower cylindrical portion.

Optionally, it is possible to provide (at least) one fan, indicated by Z1 in FIG. 2, in the area between the lower plates 14 and 18. Alternatively, a fan of this kind can be incorporated, for example, in the area indicated by Z2 in the support block 15, or in the area indicated by Z3 in an external pipe connected to the region lying between the plates 14 and 18. The aforementioned fan or fans are designed to create a flow of air (secondary air) towards the lower part of the outer chamber 58.

The operation of the device 10 will now be described, with particular reference to FIGS. 8 and 9.

FIG. 8 shows a stage of the operation of the device in coaxial gasification mode.

Initially, primary fuel 100 (in solid, powder or even liquid form) is introduced into the inner chamber 56, until it is above a predetermined filling level.

Primary air A1 for supplying primary combustion in the combustion chamber 56 enters through the central aperture or mouth 36.

In these conditions, a flow of secondary air A2 enters the outer chamber 58 through the apertures 28 in the base plate 14, by natural convection or by forced convection (for example, in the case in which the device 10 has a fan which facilitates the axial movement of the flow of secondary air A2 through the base aperture 28).

It should be noted that, advantageously, the transverse profile of the annular projection 30 of the base plate 14 is such that the secondary air flow A2 is compressed and accelerated towards the upper annular portion 59 of the outer chamber 58. This arrangement helps to improve the efficiency.

The initial combustion of the fuel in the inner chamber 56 heats the inner lateral wall 20, and therefore also heats the secondary air A2 present in the annular part 59 of the outer chamber 58, thus creating a "chimney effect" in said outer chamber 58.

It will also be appreciated that the primary combustion generates a combustible gas B in the chamber 56 (FIG. 8), and some of this gas is drawn into the chamber 58 through passages formed in the radial recesses 50 of the plate 19, between the circumferential channel 52 and the inner wall 20. These first passages formed through the radial recesses 50 act as Venturi tubes directed radially to the outside of the inner lateral wall 20 and towards the annular portion 59 of the outer chamber 58, in such a way that the secondary air flow A2 entering the outer chamber 58 draws the combustible gases B out of the inner chamber 56.

Figure 9:
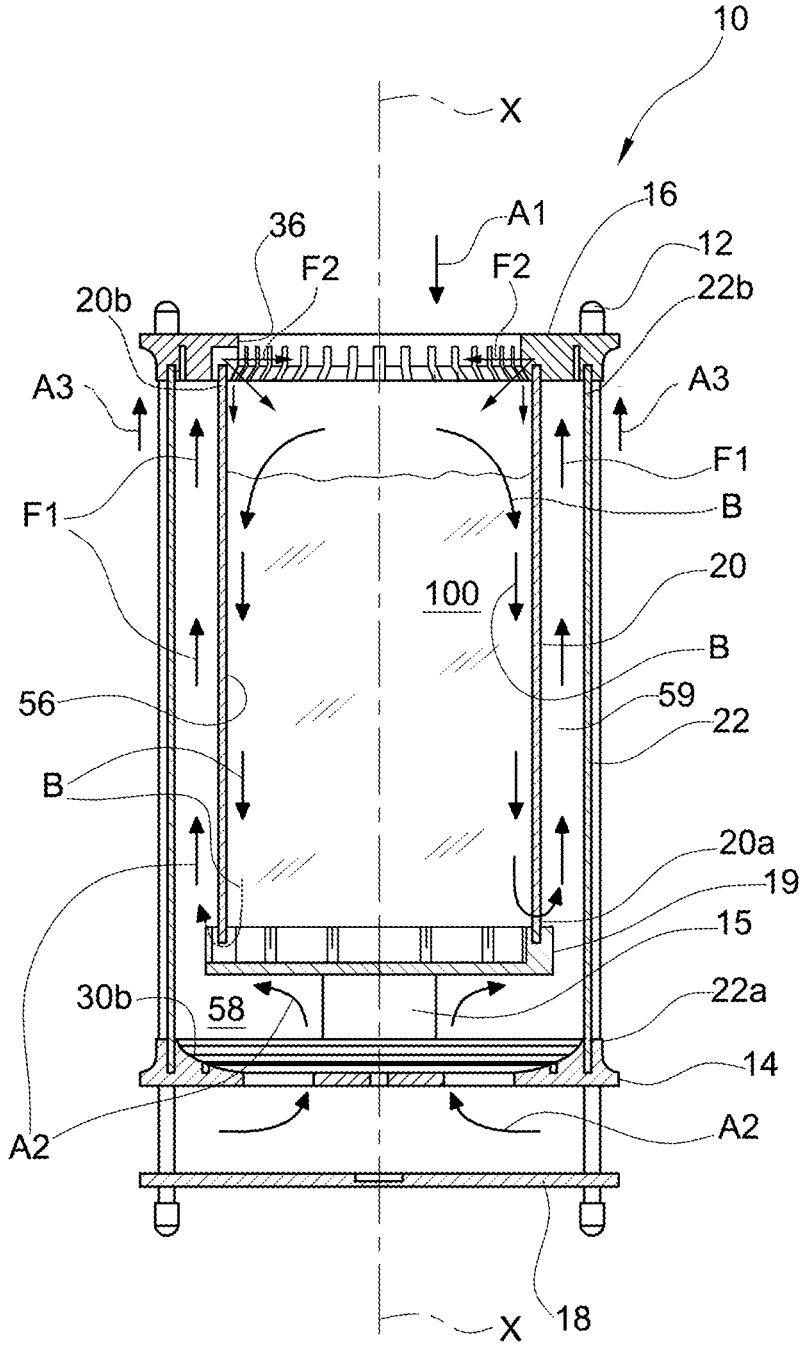

With reference to FIG. 9, this shows a phase of regular operation in the gasification mode of the device 10.

Because of the aforementioned chimney effect, the combustion gases B (or "syngas" or "process gas" or "illuminating gas") enter the annular part 59 of the outer chamber 58 and mix with the secondary air A2, forming a combustible gaseous mixture F1.

This combustible gaseous mixture F1 is accelerated towards the top of the chamber 58 and can advantageously create a radial inflow of tertiary air A3 towards the inside of the top plate 16, through passages 39*c* (FIG. 5*a*) which extend radially beyond the outer wall 22.

These passages also act as Venturi tubes. Thus a further combustible gaseous mixture F2 is formed in the channels or grooves 39 (FIG. 9) and this mixture is compressed and accelerated radially inwards, entering the central aperture or mouth 36.

If the outer wall 22 is made from a bent sheet or panel with overlapping edges, it enables the tertiary air flow to be automatically regulated.

This is because, at the start of operation, this wall 22 is "cold" and is positioned next to the inner wall of the groove 44. In this condition, the cross section of the passages for the tertiary air supply is maximal.

Subsequently, as the wall 22 heats up, it tends to move towards the outer wall of the groove 44, thus progressively reducing the passage cross section for the tertiary air.

Overall, in a device according to the invention, a multistage compression takes place, as follows: there is a first compression of the secondary air, resulting from the geometry of the region 58 downstream of the lower end of the annular chamber 59; there is a second compression of the mixture of gas and secondary air in the annular chamber 59, due to the "chimney effect" (thermal effect) created in this chamber; and there is a third compression, caused by the introduction of denser "cold" air from the outside (tertiary air), and by the cooling due to the annular top plate 16 which acts as a heat sink and whose passages 59 taper towards the outlet mouth 36.

The combustible gaseous mixture F2 is emitted from the passages 39, creating a vortex in the mouth 36 of the inner chamber 56 as a result of the special geometrical configuration of the top plate 16 and its grooves 39. This is because these passages or grooves 39 act as nozzles which inject the combustible mixture F2 towards the region of the inner chamber 56 in which the primary combustion has been initiated.

The flow of gaseous mixture F2 passing out into the mouth 36 from each groove or passage 39 in the plate 16 has a vortex component directed radially and a vortex component directed tangentially, owing to the fact that the radially inner terminal portion of the groove or passage 39 extends in a direction which forms an angle with the local radial direction.

Additionally, the flow of gaseous mixture F2 out of each groove or passage 39 has a third vortex component, directed essentially downwards, because this flow, before entering the mouth 36, is free to expand downwards at the terminal portion of the groove 39 lying between the teeth 38*c* adjacent to this groove.

Figure 12:
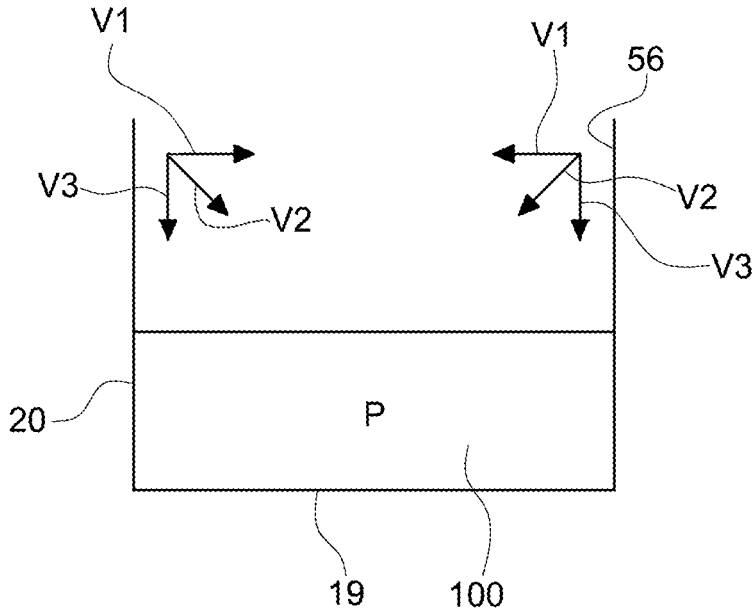
FIG. 12 is a simplified schematic representation in longitudinal section of the inner chamber of the device according to the invention, in a total pyrolysis mode of operation.

As a result of the aforesaid three vortex components (radial, tangential and vertical, indicated by V1, V2 and V3 in FIGS. 10 and 12), the flows of combustible gaseous mixture passing into the mouth 36 from the grooves or passages 39 tend to form a conical vortex which is substantially coaxial with said mouth, with the vertex pointing downwards.

The combustion of the gaseous mixture F2 flowing out into the mouth 36 is then initiated, in such a way that a "layer" of superheated, flame is created there. The pressure and velocity of the gas flows leaving the grooves or passages 39 of the annular top plate 16 are conveniently such that the combustion flames of the gases are spaced apart from the outlet ends of these grooves or passages, and therefore these flames do not "touch" the annular top plate 16. This plate can therefore be made from materials which may have a melting point below the temperature of said flames.

The flames in the mouth 36 interfuse in the inlet part of this mouth. The cap of flame in the mouth 36 therefore impedes the flow of oxygen from the region located above towards the inner chamber 56 through the central part of said mouth, in such a way that at least a central portion of the body of fuel contained in the inner chamber 56 is subjected to pyrolysis.

In other words, the radially innermost region of the chamber 56, indicated by P in FIG. 10, becomes a pyrolytic region. This is because the heat in the inner chamber 56, in the absence of any substantial amount of comburent oxygen, gives rise to a pyrolysis reaction in the radially innermost portion of the primary fuel 100.

However, the cap of flames in the mouth 36 can allow oxygen to filter from the region above towards the chamber 56 in the peripheral annular portion of the mouth.

If the body of fuel 100 in the inner chamber 56 rises above a predetermined level, a peripheral annular surface layer of this body, indicated by C in FIGS. 10 and 10*a*, is then subjected to combustion, and the underlying "ring" of fuel, indicated by G, is superheated and subjected to gasification.

Thus gasification takes place coaxially while the central region undergoes pyrolysis.

Overall, in the device 10 according to the invention this gasification process can begin after a very short time (approximately 40 seconds, for example) following the initial ignition of the fuel in the inner chamber 56. This rapid ignition and gasification also results in a drastic reduction in the emission of ashes and particulates.

The gasification process can be sustained by supplying more fuel through the peripheral part of the mouth 36, and this process can therefore be prolonged continuously, something which is not possible in stratified systems. Moreover, the device according to the invention makes it possible to have a constant ΔT, which is helpful for the control of the system and/or for the supply of systems which require a constant ΔT.

If the user wishes, the device 10 according to the invention can also operate as a totally pyrolytic, or quasi-pyrolytic, system.

Figure 11:
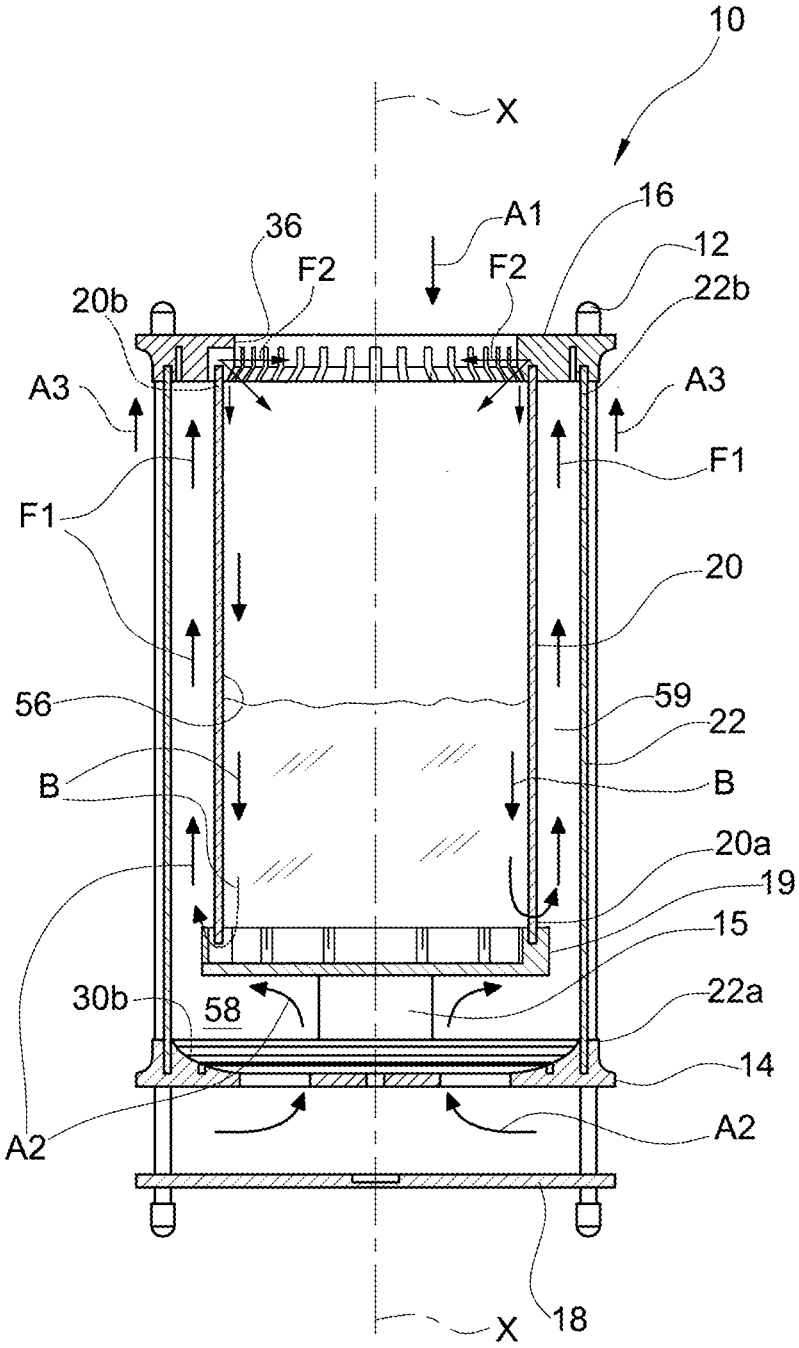
FIG. 11 is a view similar to those of FIGS. 8 and 9, and shows the gas flows in a stage of regular operation in an operating mode of total pyrolization.

In the totally pyrolytic mode, the secondary air flow A2 and the tertiary air flow A3 (FIG. 11) are regulated in such a way that the flame cap formed in the mouth 36 almost completely blocks the ingress of oxygen into the inner chamber 56 from the region above by consuming the oxygen before it can enter the fuel chamber. In this condition, the device 10 operates as a pyrolysis chamber of the open container type.

The body of fuel 100 contained in the chamber 56 is almost entirely subjected to pyrolysis, as shown in the schematic representation in FIG. 12, in which the letter P again indicates the pyrolysis region, which occupies the whole volume of the fuel.

For pyrolysis to take place, the action of the Venturi tubes formed by the passages between the inner chamber 56 and the annular chamber 59 must be balanced with the action of the tertiary air passages formed between the annular top plate 16 and the outer wall 22, in such a way that the oxygen carried by the air from the region above to the mouth 36 is almost entirely consumed before it can reach the inner chamber 56.

Figure 13:
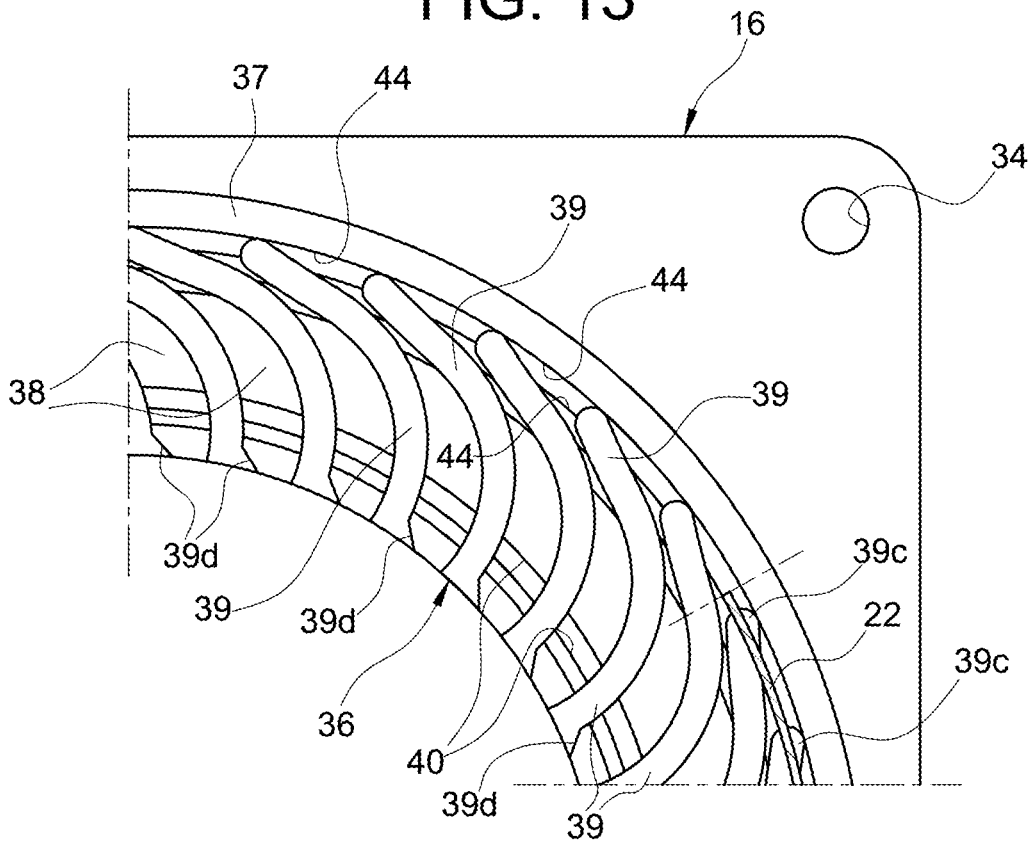
FIG. 13 is similar to FIG. 5*a* and shows a variant embodiment.

In order to establish pyrolysis in devices according to the invention for low power applications, it may be convenient for the combustion flames of the jets of gas issuing from the grooves 39 into the mouth 36 to be positioned closer to the edge of this mouth, so as to reduce the possibility of the infiltration of oxygen from the region above into the inner chamber 56 through the outer annular part of the mouth 36. For this purpose, as shown in FIG. 13, the inner ends of the grooves 39 of the annular top plate 16 have a bevel 39*d* to enable the outgoing gases to expand partially in a circumferential direction opposite the direction of rotation of the vortex created by these jets.

This expansion has the effect of bringing the combustion flames of said jets to the edge of the aperture or mouth 36.

In the totally pyrolytic operating mode, the emissions are extremely low and there is a considerable increase in the production of usable carbon residues ("char").

In all cases, the vortex created in the inner chamber 56 advantageously acts as a cyclone on the particles carried by the gases to be burnt. The action of this vortex, in combination with the inclined surfaces of the bevels 38*d* of the top plate 16, is such that said particles are carried towards and through the central pyrolized part of the fuel, which acts as an effective filter for these particles.

In the device 10 according to the invention, it is possible to introduce a combustible gas into the mouth 36 temporarily, in place of or in addition to the tertiary air A3 (see FIG. 11 for example), to accelerate the formation of the flame cap described above.

Where the materials of the components are concerned, it should be noted that the bottom plate 19 can be made, for example, from cast iron, particularly spheroidal cast iron, or ceramic material to withstand high temperatures.

The annular top plate 16 can be made from magnesium, for example. As a general rule, this plate can be made from any suitable material which can be injection molded.

In a device according to the invention, a "gas wick", as described in the article by Reed and Larson cited in the introduction to this description, can be positioned coaxially in the inner chamber 56 to enable the excess combustible gas generated to be removed from this chamber for other uses.

However, the introduction of a gas wick could create excessive turbulence in the aforesaid chamber, unless special arrangements are made.

In order to avoid this drawback, the annular top plate 16 can be made with the grooves 39 orientated (in the jet outlet area) in such a way that the issuing jets overlap each other in the outermost annular zone of the mouth 36, leaving a central area of this mouth in which a gas wick can be positioned to extract the excess gas produced, without any effects on the operation of the device.

A device according to the invention can be used as a heat generator, in the form of a stove, or in power generation plants.

This device is also suitable for use as a cooker for cooking food.

Finally, the device can also be used as a jet engine without moving parts to generate a fluid dynamic force.

In the device according to the invention, the Venturi tubes and the nozzles are formed by the shaping of the various parts and their assembly, and do not require drilling operations.

The height, and consequently the useful volume, of the chambers in a device according to the invention can be modified easily, simply by using cylindrical walls of greater or lesser length.

Naturally, the principle of the invention remaining the same, the forms of embodiment and the details of construction may be varied widely with respect to those described and illustrated, which have been given purely by way of non-limiting example, without thereby departing from the scope of the invention as defined by the attached claims.

The invention claimed is:

1. A device comprising:

(a) an inner chamber formed by an inner tubular wall, a top plate, and a dividing plate, said top plate having a mouth communicating with the external environment, said inner chamber adapted to receive fuel through said mouth;

(b) an outer chamber formed by an outer tubular wall coaxial with said inner tubular wall, said top plate, and a base plate, said base plate having at least one aperture communicating with the external environment and being spaced from said dividing plate, said outer chamber comprised of a lower cylindrical portion under said inner chamber and an upper annular portion between said inner tubular wall and said outer tubular wall;

(c) a plurality of circumferentially staggered lower passages through which said inner chamber communicates with said annular portion at said dividing plate; and (d) a plurality of circumferentially staggered upper passages through which said annular portion communicates with said inner chamber at said top plate;

(e) whereby gases evolved in said inner chamber flow through said lower passages, rise through said annular portion, and flow through said upper passages into said inner chamber where they produce localized combustion primarily in said mouth, forming a flamecap.

2. The device of claim 1 wherein said top plate has a peripheral circumferential groove and wherein said upper passages are curved grooves, each of which extends from said peripheral circumferential groove to said mouth, adjacent pairs of said curved grooves having correspondingly curved projections formed therebetween, the upper edge of said outer tubular wall being engaged in said peripheral circumferential groove.

3. The device of claim 2 wherein said top plate has an inner circumferential groove coaxial with said peripheral circumferential groove and which intersects said curved grooves, the depth of said inner circumferential groove being less than that of said curved grooves, the upper edge of said inner tubular wall being engaged in said inner circumferential groove.

4. The device of claim 3 wherein said top plate has an intermediate circumferential groove coaxial with said peripheral circumferential groove and said inner circumferential groove and which intersects said curved grooves, the depth of said intermediate circumferential groove being less than that of said curved grooves.

5. The device of claim 3 wherein radially inner ends of said curved grooves are orientated such that jets of gas leaving said curved grooves create a downwardly pointing, conical vortex substantially coaxial with said mouth.

6. The device of claim 3 wherein the radially inner ends of said curved projections have corresponding bevels lying essentially on a cone that is coaxial with said mouth and converging in an upward direction.

7. The device of claim 3 wherein each curved groove has a substantially rectilinear outer portion which is inclined with respect to the radial direction and which communicates with the external environment, an approximately radial inner portion, and a curved intermediate portion connecting said outer portion and said inner portion.

8. The device of claim 1 wherein said bottom passages are transverse grooves in said bottom plate and wherein said bottom plate has a circumferential groove that is shallower than said transverse grooves, the lower edge of the said inner tubular wall being engaged in said circumferential groove, said bottom passages being sized to draw air through said mouth and said flamecap at a rate that causes almost all of the oxygen in said air to be consumed, thereby leaving said inner chamber charged substantially with heated nitrogen.

9. The device of claim 1 wherein said base plate has an outer circumferential groove, the surface of said base plate inside said outer circumferential groove curving downwardly from said outer circumferential groove, the lower edge of said outer tubular wall being engaged in said outer circumferential groove.

10. The device of claim 9 wherein said base plate has an inner circumferential groove coaxial with said outer circumferential groove.

11. The device of claim 1 wherein said base plate is spaced from said dividing plate by a support block.

* * * * *